US006112668A

United States Patent [19]

Woodall et al.

[11] Patent Number: 6,112,668

[45] Date of Patent: Sep. 5, 2000

[54] MAGNETO-INDUCTIVELY CONTROLLED LIMPET

[75] Inventors: Robert Woodall, Lynn Haven; Felipe Garcia, Panama City; John Sojdehei, Panama City Beach, all of Fla.

[73] Assignee: The United States of America as represented by the Secretary of the Navy, Washington, D.C.

[21] Appl. No.: 09/040,184

[22] Filed: Feb. 17, 1998

[51] Int. Cl.[7] ..... F42B 22/04

[52] U.S. Cl. ..... 102/417; 102/406; 102/427

[58] Field of Search ..... 102/401, 406, 102/416, 417, 418, 419, 420, 424, 426, 427, 215

[56] References Cited

U.S. PATENT DOCUMENTS

| | | | |
|---|---|---|---|
| 2,881,702 | 4/1959 | Glennon et al. | 102/417 |
| 3,004,488 | 10/1961 | Wieland, Jr. | 102/417 |
| 3,735,703 | 5/1973 | Bayer et al. | 102/406 |
| 4,615,268 | 10/1986 | Nakano et al. | 102/217 |
| 4,635,554 | 1/1987 | Palmer | 102/420 |
| 4,860,653 | 8/1989 | Abouav | 102/200 |
| 5,027,709 | 7/1991 | Slagle | 102/427 |
| 5,038,406 | 8/1991 | Titterton et al. | 359/113 |
| 5,170,005 | 12/1992 | Mabry et al. | 89/1.81 |
| 5,396,845 | 3/1995 | Backstein et al. | 102/427 |
| 5,450,805 | 9/1995 | Beach et al. | 102/427 |

FOREIGN PATENT DOCUMENTS

| | | | |
|---|---|---|---|
| 3442390 | 6/1985 | Germany | 102/427 |
| 2200975 | 8/1988 | United Kingdom | 102/427 |

*Primary Examiner*—Harold J. Tudor

*Attorney, Agent, or Firm*—Harvey A. Gilbert; Donald G. Peck

[57] ABSTRACT

A limpet and method for control thereof have a receiver section responsive to magneto-inductive signals in the ELF to VLF range that arm and fire a main charge. A swimmer places the limpet and enables it for control by remotely transmitted magneto-inductive signals in the ELF to VLF range. ELF to VLF frequencies provide safe and reliable communications from a remote control platform such as a land-based command station, an aircraft, surface craft, or submarine. The appropriately coded magneto-inductive signals in the ELF to VLF range are transmitted through the sea, air, beach, buildings, vegetation and sediment or any combination of these conditions to arm and fire or disarm the limpet as called for in the battle plan.

9 Claims, 3 Drawing Sheets

MAGNETO-INDUCTIVELY CONTROLLED LIMPET

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to limpet mines. In particular, this invention relates to limpet mines that are enabled and then, armed and fired using magneto-inductive signals propagated at extremely low to very low frequencies for safe and reliable communications to the limpet mines.

Limpets are mines that can be attached to the hulls of various enemy combatants by suction cup, adhesive or magnetic means. Limpets usually are emplaced by remotely operated vehicles or swimmers. Consequently, each limpet requires fuzing that is safe and reliable yet meets certain operational requirements.

Previously, acoustic command signals have been used to control attached limpets. However, acoustic command signals have limited applications since sound cannot effectively be communicated through the air to receivers in the water. In addition, reliable communication with acoustic devices is affected by sediment, microorganism, algae, changes in salinity, thermo-clines, and multi paths in the water. Acoustic devices may also be unreliable at detecting acoustic command signals in the presence of ambient noise in the water that may come from ships, mammals, munitions, landing craft, sonar, and crashing surf. Acoustic devices are known to be incapable of reliable performance in the littoral regions associated with amphibious assault, particularly in the surf zone and noisy harbors.

A further limitation in the use of acoustic signals is that they are undesirable from a stealth perspective. If an acoustically responsive limpet is attached to the bottom of an enemy vessel and an attempt is made to arm and fire it using sonar from a friendly submarine, for example, the submarine's position would be given away and triangulated upon by other enemy combatants in the area using passive acoustic detection.

Thus, in accordance with this inventive concept, a need has been recognized in the state of the art for a limpet that can be safely and reliably controlled by magneto-inductive signals from a remote transmitter to arm and fire the limpet on command and can be initiated with coded signals.

SUMMARY OF THE INVENTION

The invention is directed to providing a limpet having a receiver section responsive to remotely transmitted magneto-inductive signals in the ELF to VLF range to arm and fire a main charge.

An object of the invention is to provide a limpet actuated by remotely originating magneto-inductive signals.

Another object of the invention is to provide a limpet safely and reliably armed and fired by remotely originating magneto-inductive signals.

Another object of the invention is to provide a limpet armed and fired by remotely originating magneto-inductive signals in the ELF to VLF range.

Another object is to provide a limpet armed and fired by signals transmitted through sea, air, beach expanses, or buildings, vegetation, and sediment or combinations of these conditions.

An object of the invention is to provide a limpet within a background of acoustic interference that is actuated by remotely originating signals.

Another object of the invention is to provide a limpet actuated by coded transmissions from a remote transmitter.

Another object of the invention is to provide a limpet armed and fired by remotely originating coded magneto-inductive signals in the ELF to VLF range.

Another object of the invention is to provide a limpet Actuated by transmitters located at land-based command stations or in aircraft, surface craft, or submarines that transmit magneto-inductive signals in the ELF to VLF range.

These and other objects of the invention will become more readily apparent from the ensuing specification when taken in conjunction with the appended claims.

DESCRIPTION OF THE PREFERRED EMBODIMENT

Figure 1:
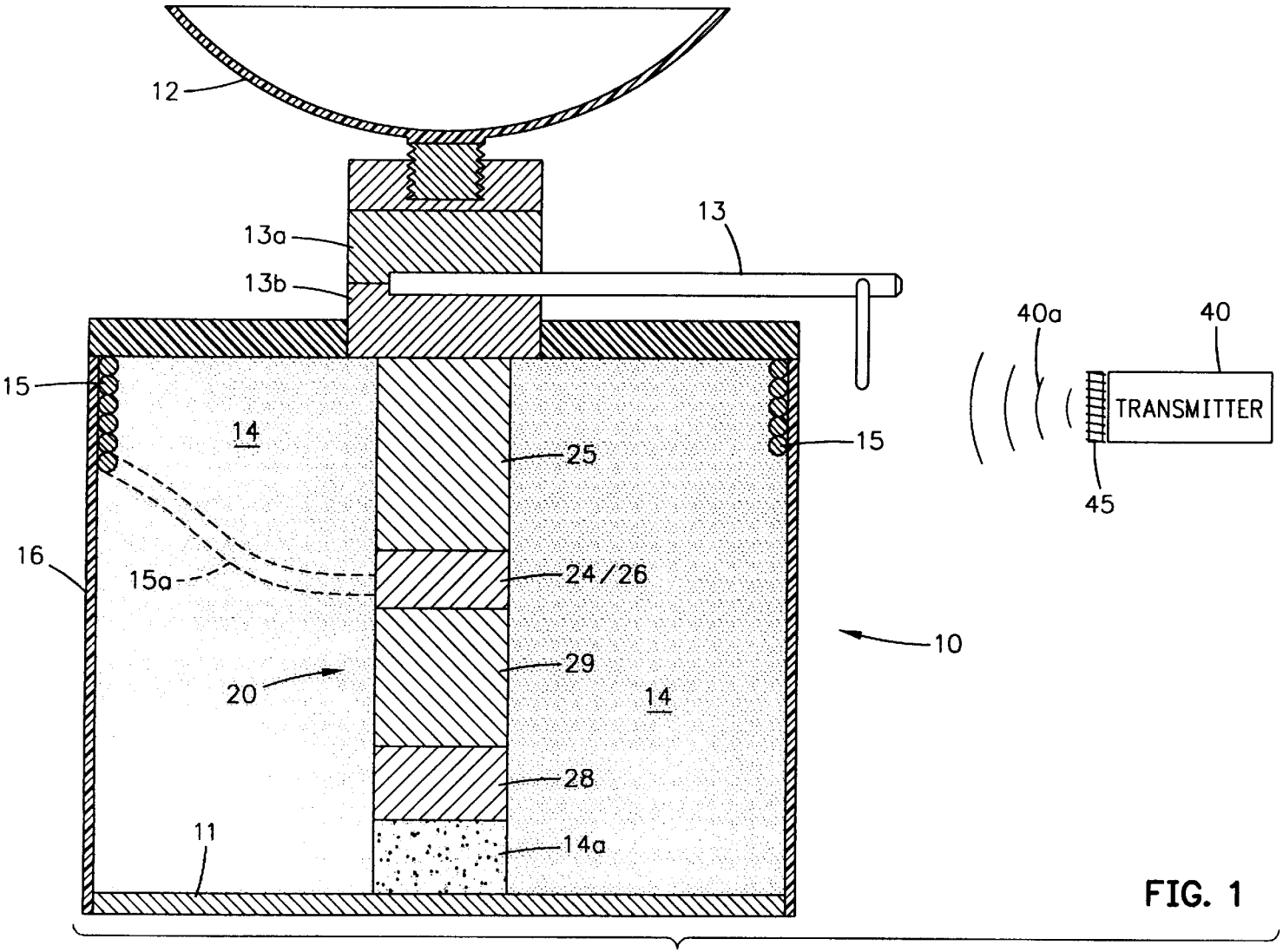
FIG. 1 is a cross-sectional view of a limpet having its antenna receiving magneto-inductive signals from a remote ELF-VLF transmitter FIG. 2 schematically depicts the remote transmitter.

Referring to FIG. 1 of the drawings, limpet 10 is schematically depicted just prior to being attached to a target in the water, such as the hull of a ship. In accordance with this invention, limpet 10 is armed and fired in response to remotely transmitted magneto-inductive signals that are propagated at extremely low frequencies (ELF) to very low frequencies (VLF). This allows for reliable control in high acoustic noise backgrounds, such as those encountered during most combat or assault operations. The use of the ELF to VLF frequencies provides safe and reliable communication suitable to fuze and detonate limpet 10 through the sea, air, beach, buildings, vegetation and sediment or combinations of these conditions.

Magneto-inductive communication with magneto-inductive signals is the use of the quasi-static AC magnetic field generated by a transmitting antenna operated with a very low radiation impedance. The transmitting antenna is either air-cored or may employ steel or ferrite for field enhancement. The receiver antenna may have a similar construction as the transmitter antenna. In bidirectional communication the same antenna can be used either as a transmitter or as a receiver.

Limpet 10 includes a magnet 11 or suction cup 12 so that a swimmer can readily attach it to a ship's hull or other submerged target without being detected. After limpet 10 is attached to the target, the swimmer removes safety pin 13 to connect seawater sensor and delay timer battery 13*a* to seawater sensor and delay timer 13*b*. This interconnection starts a predetermined delay to give the swimmer sufficient time to safely leave and to enable receiver section 20 of limpet 10 for responsive control by remote transmitter 40.

Receiver section 20 is contained in a fuze well of limpet 10 that is coaxially disposed within main charge 14 of explosive. Antenna 15 is coupled to receiver section 20 by means of lead 15*a,* and is wrapped about the charge 14 in contact with the inner surface of the non-ferrous shell 16 of limpet 10. Antenna 15 is appropriately designed to effectively receive magneto-inductive control signals in the ELF to VLF range from transmitter 40. Transmitter 40 usually is located a considerable distance away from limpet 10 on a remote control platform. The control platform may be a land-based command station or may be in aircraft, surface crafts, or submarines that transmit the appropriately coded or encrypted magneto-inductive signals 40*a* in the ELF to VLF range to limpet 10.

Figure 2:
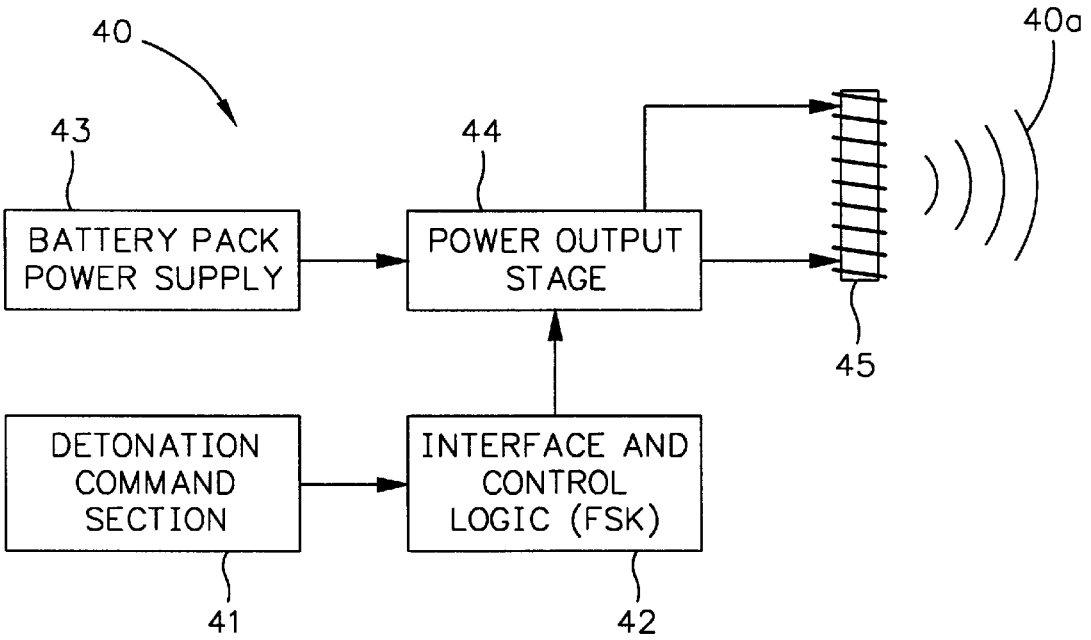

Referring to FIG. 2, transmitter 40 includes detonation command section 41, which may be a laptop computer, interface and control logic module 42, battery pack power supply 43, power output stage 44, and magneto-inductive transmitter antenna 45. Detonation command section 41 has a number of switches and interconnected LEDs. When certain ones of these switches are selected and appropriately actuated, the LEDs on the top and the bottom of the switches, will light up to indicate that the designated command is ready to be transmitted to limpet 10.

The output of detonation command section 41 is connected to interface and control logic module 42. When the operator presses the send button on detonation command section 41 or presses a predefined key on the laptop keyboard, this control logic module 42 will receive the command(s) and will encode the command to a series of predetermined tones (or bits). Next, control logic module 42 modulates these tones (or bits) by using the audio frequency shift keying (AFSK) modulation technique at a carrier frequency less than 4000 Hz, which is in the ELF to VLF frequency range. Any of a number of different carrier frequencies in the spectrum within the ELF to VLF range could be used to responsively control limpet 10. Furthermore, a number of additional limpets 10 could be armed and fired by command signals within the same time frame on different ones of the ELF and VLF frequencies. One frequency could be used to fire several limpets virtually simultaneously.

A suitable power supply for transmitter 40 can be drawn upon as the circumstances permit. For example, battery pack power supply 43 might consist of a rechargeable battery which is used to drive power output stage 44. Power output stage 44 may be power MOSFET drivers appropriately driving transmit antenna 45 to transmit the designated command signals 40*a* to limpet 10.

As mentioned above, magneto-inductive signal transmitter 40 is located in the command module of a host control platform, such as a submarine, surface vessel, remotely operated vehicle, aircraft or a land-based station. The laptop PC of detonation command section 41 is programmed to provide n+1 switches which represent one switch for each of n commands and one send, or transmit command. Each switch setup represents a discreet and distinguishable command signal for separate ones of the n commands. Each command signal is defined as a series of tones or bits which are generated by the modulation of a carrier frequency. The number of commands can be easily increased by increasing the number of tones or bits, such as T1, T2, and T3, for example, and by determining what the tones are, the command is identifiable. In addition, adding more tones or bits than T1, T2, and T3, could make this highly secure communication channel even more secure and flexible by allowing communications to be further encrypted. Typically, these tones T1, T2, and T3 could represent exemplary commands such as:

| Tones or Bits | | | |
|---|---|---|---|
| T3 | T2 | T1 | Commands |
| 0 | 0 | 0 | IDEAL |
| 0 | 0 | 1 | ON |
| 0 | 1 | 0 | OFF |
| 0 | 1 | 1 | ARM |
| 1 | 0 | 0 | DISARM |
| 1 | 0 | 1 | FIRE |
| 1 | 1 | 0 | SELF-STERILIZE |

To transmit a command signal, the operator sets the switches in detonation command section 41 to an appropriate position so that it transmits the preselected ones or combinations of tones or bits T1, T2, and T3. Discreet and distinguishable combinations of T1, T2, and T3 represent distinct command signals for limpet 10. The operator then presses the send button and the designated command signal is transmitted.

Upon receipt of the command signal, limpet 10 will arm, fire, disarm, sterilize or respond to perform whatever other command that has been transmitted. Receiver section 20 of limpet 10 receives magneto-inductive signals 40*a* from transmitter 40 on receiving antenna 15 and effects the indicated action.

Figure 3:
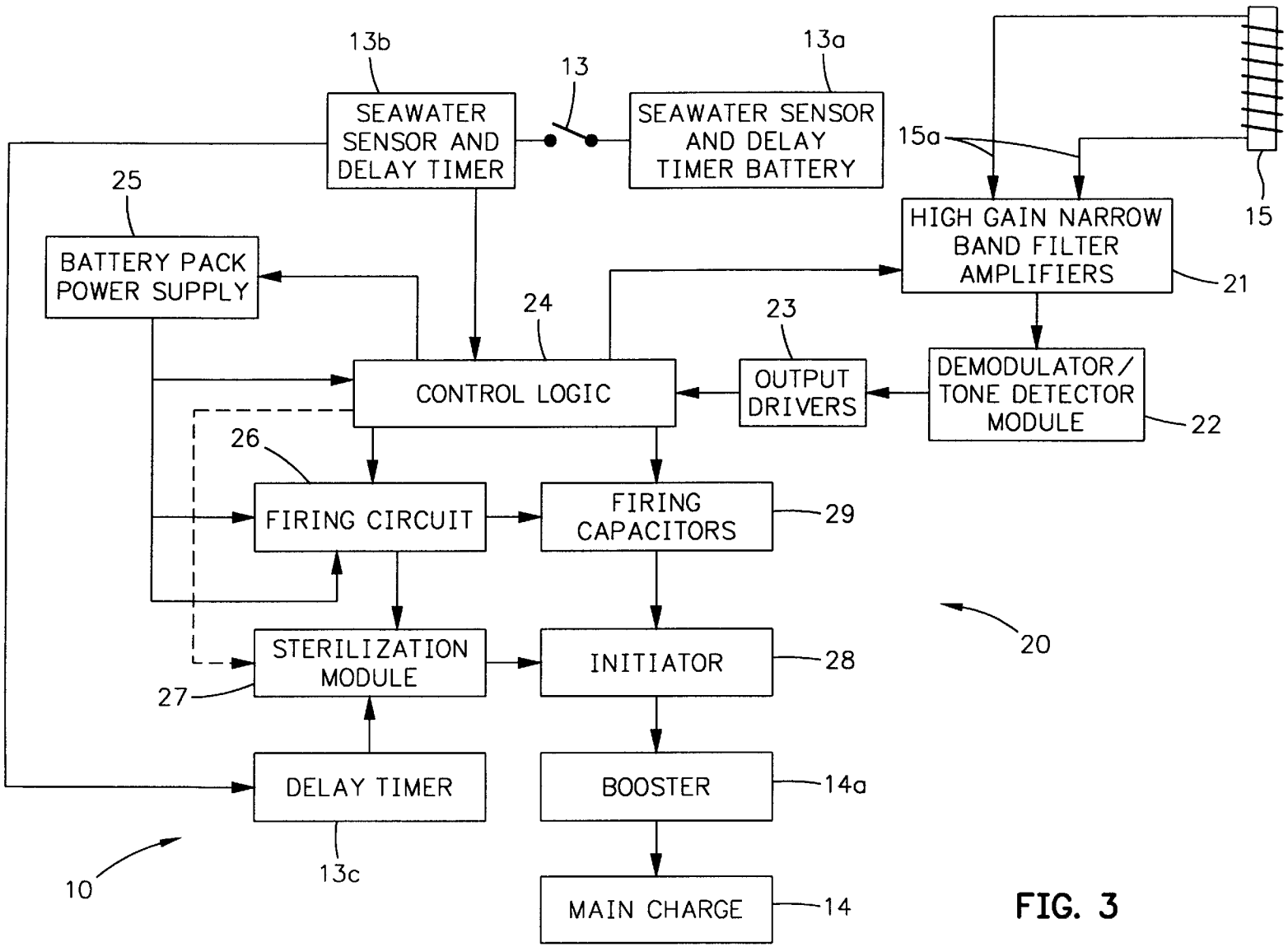
FIG. 3 schematically shows details of the limpet.

As shown in FIG. 3, receiver section 20 has receiver antenna 15 connected via leads 15*a* to two high gain narrow band filter amplifiers 21 serially coupled in a single superheterodyne configuration. The output from amplifiers 21 is fed to demodulator/tone detector module 22. Module 22 may include an amplitude modulation AM demodulator to detect the smallest amplitude modulation of the carrier frequency and narrow band phase locked loop (PLL) based tone decoders which determine the desired tones. The PLL converts the tone bursts into the corresponding voltage levels necessary to reconstruct the transmitted tones or digital data which were sent from remote transmitter 40. The output of the PLL is coupled to output drivers 23 to drive logic unit 24 of limpet 10. This also causes generation of the proper voltages from power supply 25 for responsive actuation of firing circuit 26 and subsequently for inhibition or detonation of limpet 10.

Firing circuit 26 relies upon a DC-DC voltage converter to multiply the power of power supply 25 to approximately 3,000,000 watts. Firing circuit 26 also has a plurality of separate and independent fast switches to deliver the power from firing capacitors 29 to high voltage initiator 28. Initiator 28 can be either an exploding foil initiator, such as an output charge of HNS-type IV explosive, or a laser that transfers the high power directly into photons which function as the means to transfer energy into HNS-type IV explosive. Initiation of the HNS-type IV explosive results in the detonation of booster charge 14*a* and subsequently main charge 14. Typically, high voltage initiator 28 requires approximately 0.23 Joules, with a threshold voltage of approximately 1350 volts using a 0.25 micro farad capacitor in a circuit having no more than 25 nano-henries of inductance. To achieve reliable function a spark gap switch or faster device is used in an appropriate spark gap trigger circuit.

Logic unit 24 also logically discriminates to effect safety functions within limpet 10. The sequence ON-ARM-FIRE is required to be sequenced within a prescribed period of time. If this does not happen, receiver section 20 reverts to a SAFE (or OFF) 010 status when logic circuit 24 initiates sterilization module 27.

Sterilization module 27 may operate to prevent any signal from activating initiator 28. Sterilization module 27 may also inhibit initiator 28 when delay timer 13*c* indicates that too long of an interval has lapsed since pin 13 has been removed or possibly that the ON-ARM-FIRE window of time has been exceeded.

When the ON-ARM-FIRE signal sequence is received within the prescribed window of time, logic unit 24 proceeds to bring about the detonation of main charge 14. Each ON, ARM, and FIRE signal causes logic circuit 24 to open three independent and isolated circuit switches in firing circuit 26. The ON signal from seawater sensor and remote timer 13*b* causes logic circuit 24 to open at least one independent and isolated circuit switch in firing circuit 26 to couple it to power from power supply 25. The ARM signal opens at least one associated independent and isolated switch in firing circuit 26 to charge all of firing capacitors 29 prior to the FIRE command signal. The FIRE command signal opens the associated independent and isolated switch in firing circuit 26 to discharge capacitors 29 to initiator 28. This initiates initiator 28 and booster charge 14*a* which detonates main charge 14. Thus, when all three independent and isolated switches are opened, the composite signal transfers the FIRE command from firing circuit 26 and main charge 14 is detonated.

The invention herein has been described using an exemplary arrangement of components, coding sequences, and possible commands for remote detonation of limpet 10. This arrangement is not to be construed as limiting, but rather is intended for demonstrating this inventive concept. Having this disclosure in mind, one skilled in the art to which this invention pertains will select and assemble suitable components from among a wide variety available in the art and appropriately interconnect them to satisfactorily function as the disclosed constituents of transmitter 40 and receiver section 20.

The disclosed components and their arrangements as disclosed herein all contribute to the novel features of this invention. These novel features assure more reliable and effective use of limpets 10 to successfully perform a wide variety of undersea missions. For example, it is to be understood that the configuration and capabilities of limpet 10 and the components of receiver section 20 could be modified to accommodate different requirements and still be within the scope of this inventive concept. For example, different combinations of frequencies in the ELF to VLF range could be selected, different commands, different coding schemes and modulation techniques could be selected to better accommodate different mission requirements without departing from the scope of this invention. Other detonating trains could be incorporated in limpet 10 and the modified structure would still be in the scope of this invention.

Therefore, it is to be understood that, having the teachings of this invention in mind, one skilled in the art to which this invention pertains can select other combinations of components, materials, and arrangements thereof and still be within the scope of this invention. Similarly, the capabilities of the invention that were disclosed herein were selected for the purpose of demonstration of some salient features of this invention. They are not to be construed to limit the scope of this invention.

It should be readily understood that many modifications and variations of the present invention are possible within the purview of the claimed invention. It is to be understood that within the scope of the appended claims the invention may be practiced otherwise than as specifically described.

We claim:

1. A limpet comprising:

a main charge;

a receiver section including, means responsive to first magneto-inductive signals in the ELF to VLF range for generating signals to arm said receiver section of said limpet and means responsive to second magneto-inductive signals in the ELF to VLF range for generating signals to fire said main charge of said limpet;

means for providing signals to enable said arming signal generating means and said firing signal generating means; and an antenna wrapped about said main charge being responsive to impinging magneto-inductive signals in the ELF to VLF range and connected to said receiver section.

2. A limpet according to claim 1 in which said arming signal generating means and said firing signal generating means have control logic and firing circuits to generate said arming and firing signals.

3. A limpet according to claim 2 in which said enabling means includes a water sensor and delay timer activated by a diver when said limpet is deployed in the water.

4. A limpet comprising;

a non-ferrous container having an enclosing shell;

a main explosive charge disposed in said container, and having a centrally disposed fuze well;

a means for receiving magneto-inductive signals in the ELF to VLF range to arm and fire said main charge, said receiving means disposed in said fuze well;

a means for enabling said receiving means with said magneto-inductive signals in the ELF to VLF range to arm and fire said main charge, said enabling means disposed through said container shell between and in contact with said receiving means and the environment external to said limpet; and a means for controlling activation of said enabling means.

5. The limpet of claim 4 wherein said receiving means comprises:

a receiver section disposed said fuze well; and a receiving antenna disposed about said main explosive charge and in contact with an interior wall of said shell.

6. The limpet of claim 5 wherein said receiver section comprises:

a means for providing logic and firing signals, said logic and firing providing means being connected to said enabling means;

a means for providing main charge initiation being connected between said main charge and said logic and firing signal providing means; and a power supply connected to said logic and firing signal providing means.

7. The limpet of claim 6 wherein said enabling means comprises a seawater sensor and delay timer.

8. The limpet of claim 6 wherein said means for providing logic and timing signals comprises:

a control logic module connected between said enabling means, said power supply, said logic and firing signal providing means, said main charge initiation providing means, and said receiving means.

9. The limpet of claim 8 wherein said logic and firing signal providing means comprises:

a firing circuit connected to said power supply and said control logic module;

firing capacitors connected to said control logic module and said firing circuit;

a booster charge connected to said main charge; and an initiator connected between said booster charge and said firing capacitors.

* * * * *